US008727466B2

(12) United States Patent
Inoue et al.

(10) Patent No.: US 8,727,466 B2
(45) Date of Patent: May 20, 2014

(54) INK JET PRINTER AND AIR PURGING CONTROL METHOD THEREFOR

(75) Inventors: Tomohiro Inoue, Tsukuba (JP); Toshihide Nagamine, Tokai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 383 days.

(21) Appl. No.: 13/030,314

(22) Filed: Feb. 18, 2011

(65) Prior Publication Data

US 2012/0001968 A1 Jan. 5, 2012

(30) Foreign Application Priority Data

Jun. 30, 2010 (JP) ..... 2010-148559

(51) Int. Cl.
*B41J 2/195* (2006.01)

(52) U.S. Cl.
USPC ..... 347/7; 347/34

(58) Field of Classification Search
USPC ..... 347/7, 84, 85, 86, 74, 25, 34
See application file for complete search history.

(56) References Cited

U.S. PATENT DOCUMENTS 5,331,339 A 7/1994 Takahashi
5,532,720 A * 7/1996 Krueger et al. ..... 347/7
6,174,052 B1 * 1/2001 Eremity et al. ..... 347/74
2005/0212874 A1 * 9/2005 Nomura et al. ..... 347/84
2007/0229611 A1 * 10/2007 Nagashima ..... 347/84
2008/0024553 A1 * 1/2008 Morgan et al. ..... 347/42

FOREIGN PATENT DOCUMENTS

| | | | | |
|---|---|---|---|---|
| JP | 60-011364 | | 1/1985 | |
| JP | 7-125256 | | 5/1995 | |
| JP | 07-205448 | | 8/1995 | |
| JP | 1995-205448 | * | 8/1995 | ..... B41J 2/175 |
| JP | 2007-205448 | * | 8/1995 | ..... B41J 2/175 |
| WO | WO 2008/105280 | | 9/2008 | |
| WO | WO2008/117013 | | 10/2008 | |

* cited by examiner

*Primary Examiner* — Manish S Shah
*Assistant Examiner* — Yaovi Ameh
(74) *Attorney, Agent, or Firm* — Antonelli, Terry, Stout & Kraus, LLP.

(57) ABSTRACT

An ink jet printer which uses a common air pump to configure an air path system to supply purge air generated by the air pump to an ink tank and then supply the purge air discharged from the ink tank to a print head or an air path system to supply purge air generated by the air pump directly to the pint head. This solves the following problem inherent to a conventional ink jet printer which recovers ink not used for printing: since an air pump for supplying air to air-purge the print head and an air pump for supplying air to air-purge the ink tank are required, the cost and weight of the printer tends to increase.

13 Claims, 4 Drawing Sheets

INK JET PRINTER AND AIR PURGING CONTROL METHOD THEREFOR

CLAIM OF PRIORITY

The present application claims priority from Japanese Patent Application No. 2010-148559 filed on Jun. 30, 2010, the content of which is hereby incorporated by reference into this application.

BACKGROUND OF THE INVENTION

1. Field of the Invention

The present invention relates to an ink jet printer which supplies ink from an ink tank to a print head and enables ink to eject from the nozzle of the print head to perform printing and an air purging control method therefor.

2. Description of the Related Art

In an ink jet printer which supplies ink from an ink tank to a print head to perform printing and recovers ink not used for printing into the ink tank, control of the properties of ink is essential for the stable formation of ink droplets. Particularly for an ink jet printer in which mixing with a nozzle cleaning solvent causes a decrease in the ink concentration, a technique as described in JP-A No. H7(1995)-205448 is used in which the inside of the ink tank is ventilated to accelerate volatilization of such solvent to restore the original ink concentration.

In the ink jet printer as described in JP-A No. H7(1995)-205448, a lot of dust and ink mist may be suspended around the print head and when air is supplied into the print head to air-purge it in order to remove such dust and ink mist, an air source for air-purging the print head is required in addition to the air pump used for air purging in the ink tank. The use of such an additional air source leads to a rise in the cost. In addition, when the ink tank is air-purged, exhaust air is forced out of the printer main unit and released to the atmosphere. If ventilation around the printer is insufficient, the solvent concentration may go up, causing the operator to feel uncomfortable.

SUMMARY OF THE INVENTION

According to one aspect of the present invention, there is provided an ink jet printer which includes ink supply means for supplying solvent-containing ink stored in an ink tank to a print head, the print head for printing on an object on which printing is to be made, and ink recovery means for recovering ink not used for printing into the ink tank, in which a single air supply means is provided for supplying purge air to the ink tank to volatilize solvent in the ink and also cleaning an inside of the print head with purge air flowing out of the ink tank.

Preferably, the air supply means in the ink jet printer includes a purge pump.

Preferably the ink jet printer further includes a purge air path for connecting the air supply means and the ink tank and a purge air discharge path for connecting the ink tank and the print head.

Preferably, in the ink jet printer, the purge air discharge path branches into an atmospheric discharge path for communication with the atmosphere and a head discharge path for connection with the print head.

Preferably, in the ink jet printer, the purge air path has means for turning on and off air.

Preferably, in the ink jet printer, the atmospheric discharge path has means for turning on and off air.

Preferably, in the ink jet printer, a head purge path for connection with the print head branches off from the purge air path.

Preferably, in the ink jet printer, the purge air path and the head purge path each include means for turning on and off air.

Preferably, in the ink jet printer, air switching means is provided at a point where the purge air path and the head purge path branch off.

Preferably, in the ink jet printer, the means for turning on and off air includes a solenoid on-off valve.

Preferably, in the ink jet printer, the air switching means includes a solenoid diverter valve.

Preferably, in the ink jet printer, the air supply means has heating means.

According to another aspect of the invention, there is provided an air purging control method for an ink jet printer which includes the steps of supplying solvent-containing ink stored in an ink tank to a print head, recovering ink not used for printing into the ink tank, supplying purge air for volatilizing solvent in the ink to the ink tank, and cleaning an inside of the print head with purge air flowing out of the ink tank. In the method, Purge Mode A in which purging of the ink tank and purging of the print head are performed and Purge Mode B in which neither purging of the ink tank nor purging of the print head is performed are selectively executed.

Preferably, in the air purging control method for an ink jet printer, Purge Mode C in which purging of the ink tank is performed and purging of the print head is not performed is further available and any of Purge Modes A to C is selectively executed.

Preferably, in the air purging control method for an ink jet printer, Purge Mode D in which purging of the ink tank is not performed and purging of the print head is performed is further available and any of Purge Modes A to D is selectively executed.

Preferably, in the air purging control method for an ink jet printer, switching is made from Purge Mode A or C to Purge Mode B or D.

According to the present invention, since a common air source is used to supply purge air to an ink tank and a print head, an ink jet printer which stabilizes the ink concentration by accelerating the volatilization of ink solvent and stabilizes the print quality by preventing foreign matter from getting into the ink head can be provided at low cost.

DETAILED DESCRIPTION OF THE PREFERRED EMBODIMENTS

Figure 1:
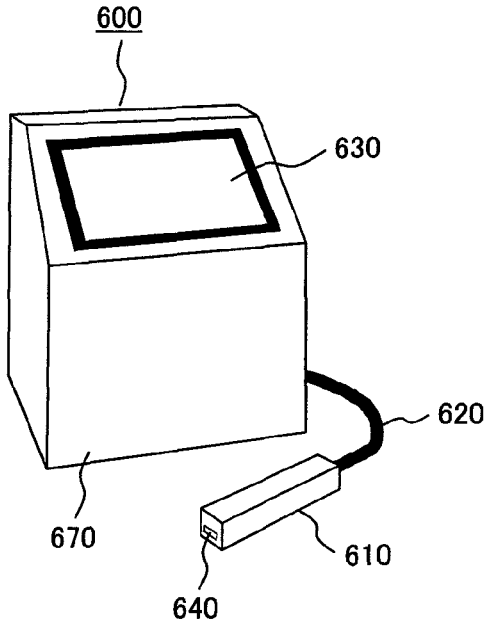
FIG. 1 is a perspective view of an ink jet printer according to the present invention.

Next, the preferred embodiments of the present invention will be described in detail referring to the accompanying drawings. FIG. 1 shows the appearance of the main unit of the ink jet printer. The ink jet printer includes the main unit 600 housing a control system and an ink circulation system, a print head 610 for ejection of ink droplets, and a cable 620 for connecting the main unit 600 with the print head 610. Generally the length of the cable 620 should be between 2 m and 6 m because the printer may be installed on a production line or the like. The main unit 600 has a touch-panel type liquid crystal panel 630 which enables the user to enter printing data or parameters and also displays control data or operating conditions of the printer.

The print head 610 houses a nozzle for generating ink droplets and electrodes for electrically charging and deflecting ink droplets and is wholly covered by a stainless steel cover. A slot 640 through which ink droplets can pass is provided at the tip of the print head 610. A door 670 is provided in a lower part of the main unit 600, permitting maintenance of the inside of the ink jet printer.

Figure 2:
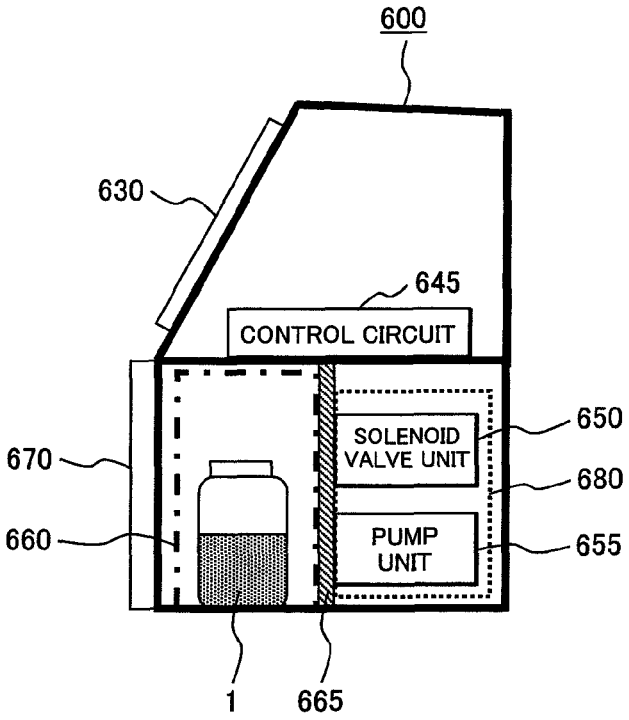
FIG. 2 is a schematic view of the ink jet printer according to the present invention.

Next, the internal structure of the main unit 600 will be described referring to FIG. 2. Electrical components such as a control circuit 645 are located in the upper part of the main unit 600. Circulation system control components such as a solenoid valve unit 650 and a pump unit 655 are housed in a rear lower part 680 of the main unit. The solenoid valve unit 650 has a supply valve, a purge valve, and an exhaust valve. An ink tank 1 is housed in a front lower part 660 of the main unit. The door 670 can be opened and closed so that the ink tank 1 can be pulled out of the main unit 60, making maintenance, including refilling and disposal of ink or solvent, easy.

Figure 3:
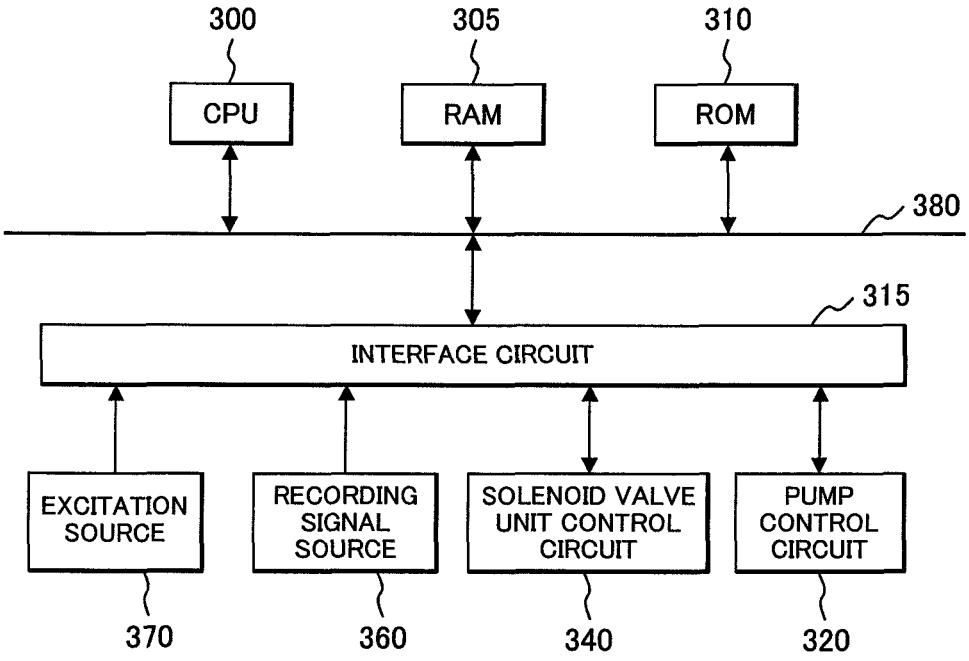
FIG. 3 is a circuit diagram for the ink jet printer according to the present invention.

Next, details of the control circuit 645 will be described referring to FIG. 3. A CPU 300 controls the ink jet printer according to the present invention. A ROM 310 is a read-only memory which stores a program and control data required for operation of the CPU 300. A RAM 305 is a rewritable memory which temporarily stores data which the CPU 300 deals with during execution of the program. A bus line 380 is a signal line for all signals including data, address signals, and control signals. An interface circuit 315 mediates input and output of data, address signals, and control signals.

A pump control circuit 320 controls the operation of a supply pump, a recovery pump, and a purge pump. A solenoid valve unit control circuit 340 controls the opening and closing of a supply valve, a purge valve, and an exhaust valve.

An excitation source 370 creates an excitation signal based on nozzle operating conditions and drives a piezoelectric actuator (not shown) in a nozzle 6. According to input printing data, a recording signal source 360 creates recording signals and print/non-print information for ink droplets, which are then stored in the RAM 305. The recording signals are sent to a charged plate 7 according to a command from the CPU 300.

First Embodiment

Figure 4:
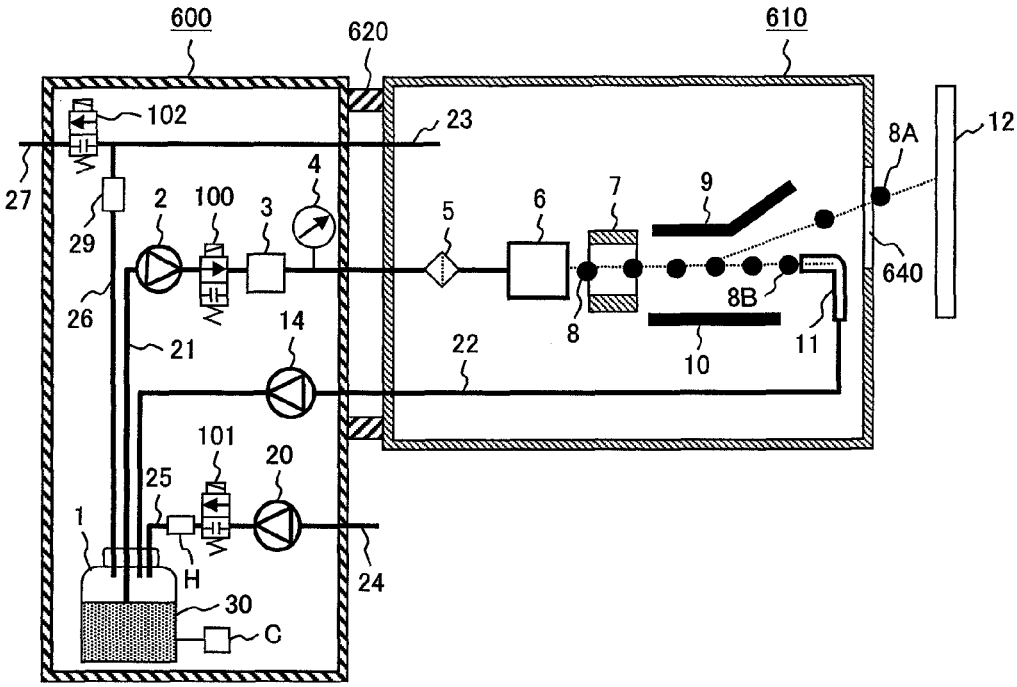
FIG. 4 is a path system diagram for an ink jet printer according to a first embodiment of the present invention.

Next, how the ink jet printer according to the first embodiment of the invention performs printing will be described referring to FIG. 4. Ink supply from the ink tank 1 to the print head 610 and ink recovery are carried out respectively through an ink supply path 21 and an ink recovery path 22, both of which are connected with the ink tank 1.

The ink supply path 21 includes the ink tank 1, a supply pump 2 for pressure-feeding ink, a ink supply valve 100 for opening and closing the ink supply path 21, a regulator 3 for regulating the ink pressure, a pressure gauge 4 for measuring the supply ink pressure, and a filter 5 and supplies ink from the ink tank 1 to the nozzle 6 at a prescribed pressure level.

Ink droplets 8 ejected from the nozzle 6 are charged by the charged plate 7 and energized with a high voltage of 5 kV and fly between a high voltage electrode 9 and a ground electrode 10. When the ink droplets 8A charged by the charged plate fly between the high voltage electrode 9 and ground electrode 10, they are deflected depending on the amount of charge and adhere to an object 12 on which printing is to be made so that printing is performed. Ink droplets 8B not used for printing are taken into a gutter 11 connected with the ink recovery path 22 and taken into the ink tank 1 by the recovery pump 14 which generates a negative pressure, so that they are reused.

The sequence of supplying purge air to the print head 610 and ink tank 1 is described below. Purge air is supplied to the ink tank 1 through a purge air path 25 and a purge air discharge path 26. When the level of ink in the ink tank 1 goes over a prescribed level or the ink is diluted with solvent, purge air is supplied to the ink tank 1 to volatilize the solvent and increase the ink concentration to a prescribed concentration level. Also, in order to remove foreign matter in the print head 610 such as dust and ink mist or prevent such foreign matter from getting into the head, the purge air passed through the ink tank 1 is supplied to the print head 610.

The purge air path 25 allows the outside air introduced through an air intake port 24 by a purge pump 20 to be pressure-fed to the ink tank 1. A purge valve 101 as a means for turning on and off air is provided in the purge air path 25 so that the purge air is turned on or off by opening or closing the valve. A heater H for heating the purge air is provided in the purge air path 25 in order to promote volatilization of the solvent. Although this first embodiment employs a sheathed heater H in order to avoid trouble caused by contact with ink, any type of heater may be used as far as it can heat air. The air intake port 24 may be provided with a filter or may be entirely located inside the main unit 600. The ink tank 1 is provided with a concentration sensor C for detecting the ink concentration. The concentration sensor C is not limited to a sensor which detects the ink concentration but it may be a sensor which detects the ink viscosity or the ink liquid level or ink volume which has increased as the ink has been mixed with solvent.

The purge air discharge path 26 allows the purge air discharged from the ink tank 1 to flow to a head discharge path 23 to supply it to the print head 610 or to an atmospheric discharge path 27 to release it to the atmosphere. The purge air discharge 26 also includes a condenser 29 which condenses and removes the moisture and solvent in the purge air passing through the path. The moisture and solvent removed by the condenser 29 may be returned to the ink tank 1 or stored in a special container. The condenser 29 may be located in any path where purge air flows.

The atmospheric discharge path 27 is provided with an exhaust valve 102 as a means for turning on and off air to open and close the path.

The purge valve 101 and exhaust valve 102 are normally closed solenoid on-off valves which close the path when not energized and open the path when energized. The purge valve 101 opens and closes the purge air path 25: when it is open, purge air is supplied to the ink tank 1. The exhaust valve 102 is located in the atmospheric discharge path 27. When the exhaust valve is open, the purge air discharged from the ink tank 1 is released through the atmospheric discharge path 27 to the atmosphere.

At this time, the path resistance of the head discharge path 23 is set to a higher level than that of the atmospheric discharge path 27, so most of air is released through the atmospheric discharge path 27 out of the main unit 600 but some air is supplied through the head discharge path 23 to the print head 610 and used for air purging.

When the exhaust valve 102 is closed, the purge air discharged from the ink tank 1 all flows through the head discharge path 23 into the print head 610 and is used for air purging.

As mentioned earlier, the pump control circuit 320 controls the operation of the supply pump 2, recovery pump 14, and purge pump 20 according to a command from the CPU 300 and the solenoid valve unit control circuit 340 controls the opening and closing of the ink supply valve 100, purge valve 101 and exhaust valve 102 according to a command from the CPU 300.

The purge pump 20 is a diaphragm air pump or similar air pump which can change the discharge flow rate according to a command from the pump control circuit 320. In the first embodiment, the preset flow rate of purge air is limited to 0.9 liter per minute or less. This is because supplying purge air to the print head 610 at a flow rate of 1 liter per minute or more can affect flying ink droplets and cause printing failures.

In the first embodiment, purge air flows are controlled in three purge modes A, B, and C depending on the opening/closing of the purge valve 101 and exhaust valve 102 and the operational state of the purge pump 20. Each purge mode is selected using the touch panel 630. These purge modes are explained below referring to Table 1.

TABLE 1

| | Purge Mode | | |
|---|---|---|---|
| | A | B | C |
| Ink tank purging | Execute | Stop | Execute |
| Print head purging | Execute | Stop | Stop |
| Purge pump 20 | On | Off | On |
| Purge valve 101 | Open | Closed | Open |
| Exhaust valve 102 | Closed | Open (Closed) | Open (Closed) |

Purge Mode A is selected and executed in order to supply purge air to both the ink tank 1 and print head 610. The CPU 300 turns on the purge pump 20, opens the purge valve 101 and closes the exhaust valve 102 so that the purge air is passed through the ink tank 1 to the print head 610 and discharged out through the slot 640 of the print head 610. This accelerates the volatilization of ink solvent in the ink tank 1 to increase the ink concentration and also prevents foreign matter such as dust and ink mist from getting into the print head 610. In addition, since the solvent volatilized in the ink tank 1 by the purge air is discharged out of the print head 610 several meters away from the main unit, the solvent does not smell so much in the vicinity of the main unit 600 where the operator works.

Purge Mode B is a purging off mode which is selected and executed in order to stop purge air supply to the ink tank 1 and print head 610. The CPU 300 turns off the purge pump 20 and closes the purge valve 101 and opens the exhaust valve 102 so that purge air supply to the ink tank 1 and print head 610 is stopped. Purge Mode B is selected when the ink concentration need not be increased and there is little foreign matter such as dust and ink mist around the print head 610. In this mode, only the air taken in through the gutter 11 by the recovery pump 14 flows in the purge air discharge path 26.

In this mode, in which the exhaust valve 102 is open, if due to air leaked from the main unit 600 the operator feels uncomfortable with the smell of the solvent, the exhaust valve 102 can be closed. In the first embodiment, the flow rate of the recovery pump 14 which is required to recover ink is 0.2 liter per minute or less and the solvent smell from the print head is far smaller than in Purge Mode A.

Purge Mode C is selected and executed in order to supply purge air to the ink tank 1 and increase the ink concentration. The CPU 300 turns on the purge pump 20 and opens the purge valve 101 and the exhaust valve 102 so that purge air is supplied to the ink tank 1 and purge air discharged from the ink tank 1 is passed through the purge air discharge path 26 and released through the atmospheric discharge path 27 to the atmosphere. This accelerates the volatilization of the solvent in the ink tank 1 and increases the ink concentration efficiently. In Purge Mode C as well, in order to reduce the solvent smell around the main unit 600, the exhaust valve 102 can be closed to discharge the purge air from the print head 610.

As explained above, in the first embodiment, three purge modes can be executed and the ink concentration and print quality can be stabilized.

Second Embodiment

Figure 5:
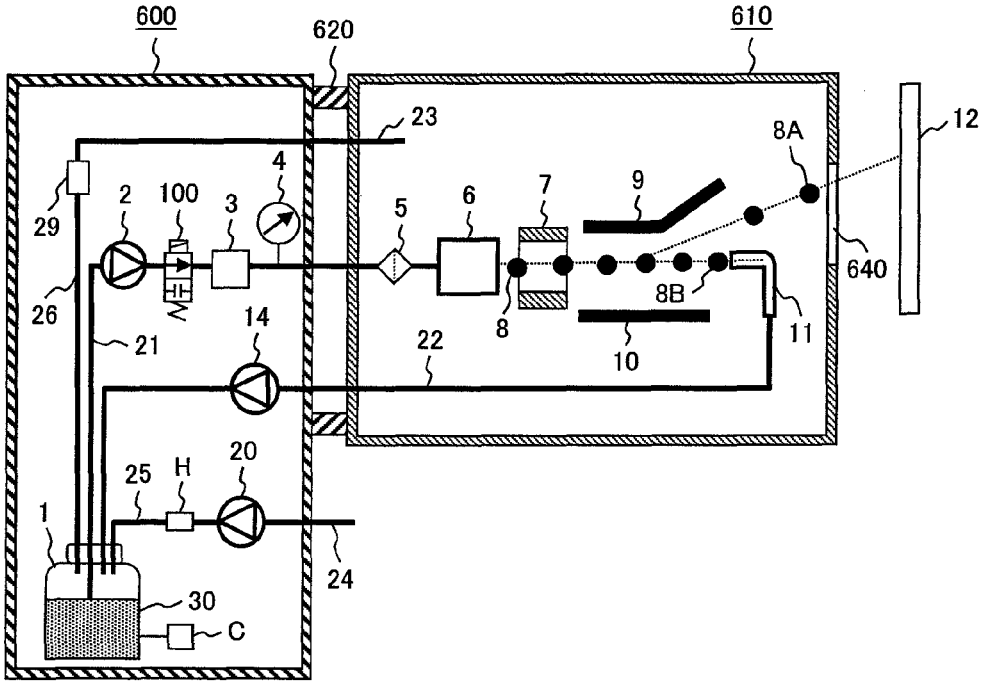
FIG. 5 is a path system diagram for an ink jet printer according to a second embodiment of the present invention.

Next, the second embodiment of the invention will be described referring to FIG. 5. Only its aspect which is different from the first embodiment is explained below. The purge pump 20 is directly connected with the ink tank 1 through the purge air path 25 and the ink tank 1 is connected with the print head 610 through the purge air discharge path 26 and head discharge path 23.

In the second embodiment, purge air flows are controlled in two purge modes A and B depending on the operational state of the purge pump 20. Each purge mode is selected using the touch panel 630. The two purge modes are explained below referring to Table 2.

TABLE 2

| | Purge Mode | |
|---|---|---|
| | A | B |
| Ink tank purging | Execute | Stop |
| Print head purging | Execute | Stop |
| Purge pump 20 | On | Off |

Purge Mode A is selected and executed in order to supply purge air to both the ink tank 1 and print head 610. The CPU 300 turns on the purge pump 20 so that purge air is supplied to the ink tank 1 and the print head 610 and released out through the slot 640 of the print head 610.

Purge Mode B is a purge off mode which is selected and executed when it is necessary to stop purge air supply to the ink tank 1 and print head 610. The CPU 300 turns off the purge pump 20 so that purge air supply to the ink tank 1 and print head 610 is stopped.

As explained above, in the second embodiment, the two purge modes can be executed and the ink concentration and print quality can be stabilized. As compared with the first embodiment, in the second embodiment, Purge Mode C, in which the ink tank is efficiently air-purged and the purge air is discharged out, is not available but the inexistence of the purge valve 101 and exhaust valve 102 can lead to cost reduction.

Third Embodiment

Figure 6:
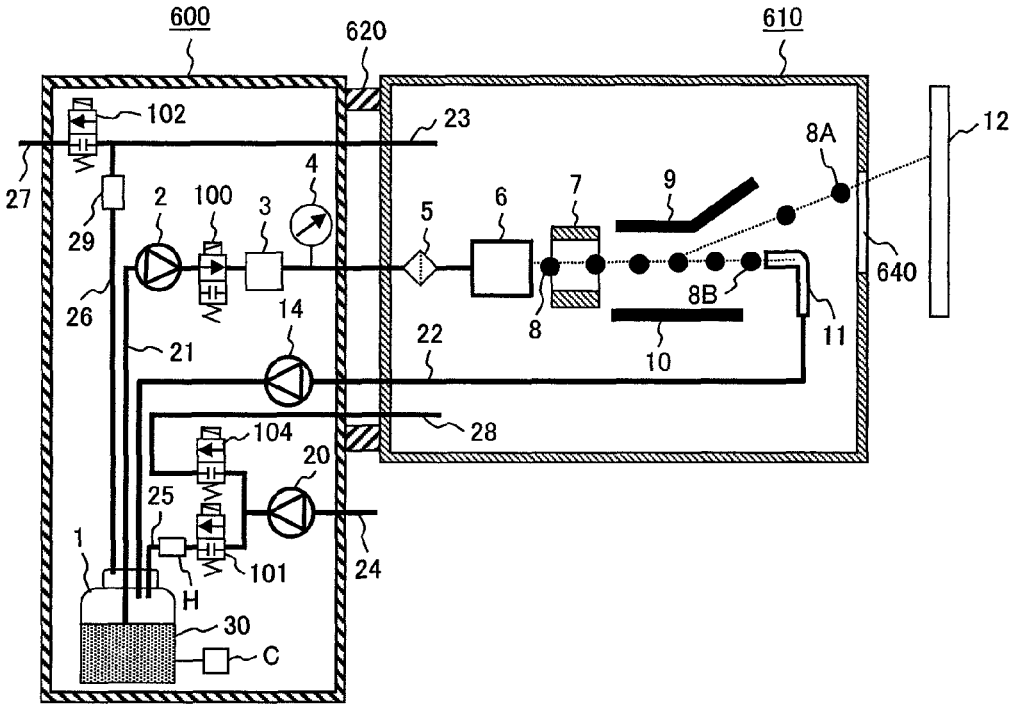
FIG. 6 is a path system diagram for an ink jet printer according to a third embodiment of the present invention.

Next, the third embodiment of the invention will be described referring to FIG. 6. Only its aspect which is different from the first embodiment is explained below.

In the third embodiment, the path branches between the purge pump 20 and purge valve 101 and a head purge path 28 for supplying purge air directly to the print head 610 is provided. The head purge path 28 includes a purge valve 104 which opens and closes the path. Like the purge valve 101, the purge valve 104 is a normally closed two-way solenoid valve and closes the path when not energized and opens the path when energized.

In the third embodiment, purge air flows are controlled depending on the operational state of the purge pump 20 and each purge mode is selected using the touch panel 630. Available purge modes are explained below referring to Table 3. Purge air flows are controlled in four purge modes A, B, C, and D depending on the opening/closing of the purge valves 101 and 104 and exhaust valve 102 and the operational state of the purge pump 20.

TABLE 3

| | Purge Mode | | | |
|---|---|---|---|---|
| | A | B | C | D |
| Ink tank purging | Execute | Stop | Execute | Stop |
| Print head purging | Execute | Stop | Stop | Execute |
| Purge pump 20 | On | Off | On | On |
| Purge valve 101 | Open | Closed | Open | Closed |
| Purge valve 104 | Closed | Closed | Closed | Open |
| Exhaust valve 102 | Closed | Open (Closed) | Open (Closed) | Closed (Open) |

In Purge Modes A, B and C, the purge valve 101 and exhaust valve 102 work in the same way as in the first embodiment and the purge valve 104 is closed. This means that these purge modes are functionally the same as the purge modes in the first embodiment.

On the other hand, Purge Mode D is selected and executed in order to supply purge air only to the print head 610. The CPU 300 turns on the purge pump 20, closes the purge valve 101 and opens the purge valve 104 so that purge air is supplied directly to the print head 610 and discharged out through the slot 640 of the print head 610. In this mode, with the exhaust valve 102 open, the air taken in through the gutter 11 can be exhausted through the atmospheric discharge path 27 or with the exhaust valve 102 closed, the air can be supplied through the head discharge path 23 into the print head 610. Purge Mode D is selected when the ink concentration need not be increased but there is a lot of foreign matter such as dust and ink mist around the print head 610.

As explained above, in the third embodiment, four purge modes can be executed and the ink concentration and print quality can be stabilized. Furthermore, the purge modes can be changed according to the result of detection by the concentration sensor H as follows. When it is detected in Purge Mode A or C (in which the ink concentration is increased) that the ink concentration is within a desired range, the mode can be changed to Purge Mode B or D to stop increasing the ink concentration.

Conversely, when it is detected in Purge Mode B or D that the ink concentration is out of a desired range, the mode can be changed to Purge Mode A or C to increase the ink concentration. The ink quality can be kept optimum by changing the purge mode depending on the ink concentration as described above.

Fourth Embodiment

Figure 7:
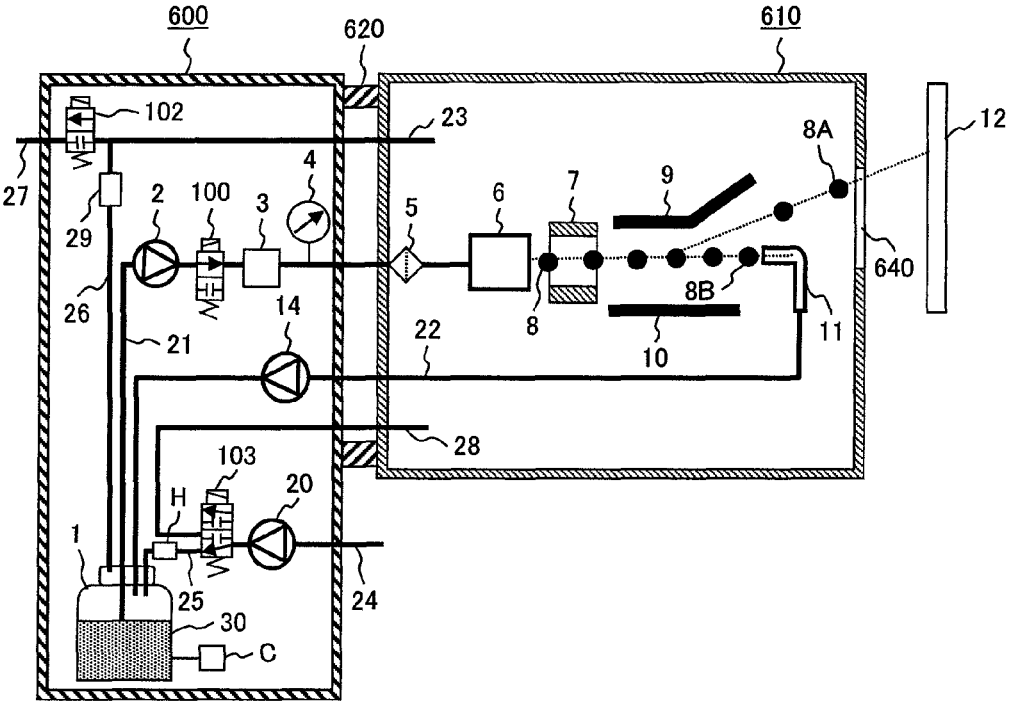
FIG. 7 is a path system diagram for an ink jet printer according to a fourth embodiment of the present invention.

Next, the fourth embodiment of the invention will be described referring to FIG. 7. In the fourth embodiment, the purge valves 101 and 104 in the third embodiment are replaced by a single purge valve 103 and its aspect which is different from the third embodiment is only explained below.

The purge valve 103 is a three-way solenoid on-off valve which switches the direction of the purge air from the purge pump 20 to let it flow into the purge air path 25 or the head purge path 28. When not energized, its purge air path 25 side is open and the head purge path 28 side is closed so that purge air is supplied to the ink tank 1. When energized, the purge air path 25 side of the valve is closed and the head purge path 28 side is open so that purge air is supplied directly to the print head 610.

How the purge valve 103 functions in Purge Modes A, B, C, and D is explained below referring to Table 4. Since the exhaust valve 102 functions as that in the third embodiment, detailed description of its function is omitted here.

TABLE 4

| | Purge Mode | | | |
|---|---|---|---|---|
| | A | B | C | D |
| Ink tank purging | Execute | Stop | Execute | Stop |
| Print head purging | Execute | Stop | Stop | Execute |
| Purge pump 20 | On | Off | On | On |
| Purge valve 103 | Print head side: Closed Ink tank side: Open | Print head side: Closed Ink tank side: Open | Print head side: Closed Ink tank side: Open | Print head side: Open Ink tank side: Closed |
| Exhaust valve 102 | Closed | Open (Closed) | Open (Closed) | Closed (Open) |

Purge Mode A is selected and executed in order to supply purge air to the ink tank 1 and print head 610. The CPU 300 turns on the purge pump 20 and de-energizes the exhaust valve 102 and purge valve 103. Consequently, purge air flows through the purge air path 25, ink tank 1, purge air discharge path 26, and head discharge path 23 into the print head 610 so that the ink tank 1 and print head 610 are air-purged simultaneously.

Purge Mode B is selected and executed in order to stop supplying purge air to the ink tank 1 and print head 610. The CPU 300 opens (energizes) the exhaust valve 102 and turns off the purge pump 20 to stop supplying purge air. Although it does not matter whether the purge valve 103 is energized or de-energized, the fourth embodiment opts to de-energize it for energy saving. Consequently, air purging of the ink tank 1 and print head 610 is stopped.

Purge Mode C is selected and executed in order to supply purge air only to the ink tank 1. The CPU 300 turns on the purge pump 20, opens (energizes) the exhaust valve 102, de-energizes the purge valve 103 and opens the purge air path 25. Purge air is supplied through the purge air path 25 to the ink tank 1 and passed through the purge air discharge path 26 and exhaust valve 102 and released through the atmospheric discharge path 27 to the atmosphere. Even in Purge Mode C, in which the exhaust valve 102 is open and air is released through the atmospheric discharge path 27 to the atmosphere, some amount of purge air flows to the print head 610 because the head discharge path 23 is open.

Purge Mode D is selected and executed in order to supply purge air only to the print head 610. The CPU 300 turns on the purge pump 20, energizes the purge valve 103 and opens its head purge path 28 side. Consequently, purge air is supplied to the print head 610 and discharged out through the slot 640 of the print head 610. As explained so far, in the fourth embodiment, four purge modes can be executed as in the third embodiment and the ink concentration and print quality can be stabilized.

In any of the foregoing first to fourth embodiments, the air purge paths are controlled by opening and closing a. It is also possible to configure a path control system which uses a static path resistance element in place of at least some of the solenoid valves which are included in the paths.

What is claimed is:

1. An ink jet printer comprising:

ink supply means that supplies solvent-containing ink stored in an ink tank to a print head;

the print head that prints on an object on which printing is to be made; and ink recovery means that recovers ink not used for printing into the ink tank, wherein a single air supply means is provided for supplying purge air to the ink tank as an outside air introduced from the outside of the ink jet printer according to at least one of the level of ink in the ink tank and the concentration of the ink to volatilize solvent in the ink for increasing the ink concentration to a prescribed concentration level, and for supplying purge air flowing out from the ink tank selectively to the inside of the print head or to the outside of the ink jet printer, and also cleaning an inside of the print head with purge air flowing out of the ink tank.

2. The ink jet printer according to claim 1, wherein the air supply means comprises a purge pump.

3. The ink jet printer according to claim 1, further comprising:

a purge air path that connects the air supply means and the ink tank; and a purge air discharge path that connects the ink tank and the print head.

4. The ink jet printer according to claim 3, wherein the purge air discharge path branches into an atmospheric discharge path for communication with the atmosphere and a head discharge path for connection with the print head.

5. The ink jet printer according to claim 4, wherein the purge air path has means for turning on and off air.

6. The ink jet printer according to claim 4, wherein the atmospheric discharge path has means for turning on and off air.

7. The ink jet printer according to claim 6, wherein the purge air path includes a head purge path for connection with the print head.

8. The ink jet printer according to claim 7, wherein the purge air path and the head purge path each include means for turning on and off air.

9. The ink jet printer according to claim 8, wherein air switching means is provided at a point where the purge air path and the head purge path branch off.

10. An air purging control method for an ink jet printer, the method comprising the steps of:

supplying solvent-containing ink stored in an ink tank to a print head;

recovering ink not used for printing into the ink tank;

supplying purge air to the ink tank as an outside air introduced from the outside of the ink jet printer according to at least one of the level of ink in the ink tank and the concentration of the ink to volatilize solvent in the ink for increasing the ink concentration to a prescribed concentration level, and cleaning an inside of the print head with purge air flowing out of the ink tank, wherein purge air flowing out from the ink tank is supplied selectively to the inside of the print head or the outside of the ink jet printer, and wherein Purge Mode A in which purging of the ink tank and purging of the print head are performed and Purge Mode B in which neither purging of the ink tank nor purging of the print head is performed are selectively executed according to the ink volume of the ink tank or concentration of the ink.

11. The air purging control method for an ink jet printer according to claim 10, wherein Purge Mode C in which purging of the ink tank is performed and purging of the print head is not performed is further available and any of Purge Modes A to C is selectively executed.

12. The air purging control method for an ink jet printer according to claim 11, wherein Purge Mode D in which purging of the ink tank is not performed and purging of the print head is performed is further available and any of Purge Modes A to D is selectively executed.

13. The air purging control method for an ink jet printer according to claim 12, wherein switching is made from Purge Mode A or C to Purge Mode B or D.

* * * * *